US012209402B2

(12) United States Patent
Lee

(10) Patent No.: US 12,209,402 B2
(45) Date of Patent: Jan. 28, 2025

(54) GEODESIC DOME STRUCTURE INCLUDING VERTICAL DOORWAY

(71) Applicant: Chan Young Lee, Seoul (KR)

(72) Inventor: Chan Young Lee, Seoul (KR)

( * ) Notice: Subject to any disclaimer, the term of this patent is extended or adjusted under 35 U.S.C. 154(b) by 0 days.

(21) Appl. No.: 18/522,254

(22) Filed: Nov. 29, 2023

(65) Prior Publication Data

US 2024/0175252 A1 May 30, 2024

(30) Foreign Application Priority Data

Nov. 30, 2022 (KR) ..... 10-2022-0163606

(51) Int. Cl.
*E04B 1/32* (2006.01)

(52) U.S. Cl.
CPC ..... *E04B 1/3211* (2013.01); *E04B 2001/3241* (2013.01); *E04B 2001/3294* (2013.01)

(58) Field of Classification Search
CPC ..... E04B 1/3211; E04B 2001/3294
USPC ..... 52/81.3
See application file for complete search history.

(56) References Cited

U.S. PATENT DOCUMENTS 2,682,235 A * 6/1954 Buckminster ..... E04B 1/3211 52/630
2,841,832 A * 7/1958 Couse ..... E04B 1/3444 52/234
3,296,755 A * 1/1967 Chisholm ..... E04C 2/405 52/745.19
3,566,554 A * 3/1971 Schaffer et al. .... E04B 1/34321 52/234
3,646,718 A * 3/1972 McKenna ..... E04B 1/34815 D25/19
3,685,221 A * 8/1972 Mangan ..... E04B 1/34 52/80.1
3,690,077 A * 9/1972 Dalgliesh, Jr. ..... E04B 1/3404 52/79.8
3,696,566 A * 10/1972 Langner ..... E04B 1/3211 D25/13

(Continued)

FOREIGN PATENT DOCUMENTS

CA 1207969 A * 7/1986 ..... E04B 1/3211
DE 2421920 A1 * 11/1975 ..... E04B 1/3211

(Continued)

OTHER PUBLICATIONS

Prefab Geodesic Dome Home Design, Denmark (May 2012).

*Primary Examiner* — Jessica L Laux
*Assistant Examiner* — Joseph J. Sadlon
(74) *Attorney, Agent, or Firm* — Revolution IP, PLLC

(57) ABSTRACT

A geodesic dome structure having a doorway in a vertical plane, includes: a single upper pentagonal planar member provided at a topmost position; five upper hexagonal planar members with vertices thereof meeting facing vertices of the upper pentagonal planar member; five middle pentagonal planar members disposed between the upper hexagonal planar members, with upper vertices thereof meeting corresponding vertices of the upper hexagonal planar member; five middle hexagonal planar members disposed between the upper hexagonal planar members and the middle pentagonal planar members; a single lower doorway hexagonal planar member disposed between the middle hexagonal planar member.

7 Claims, 5 Drawing Sheets

(56) References Cited

U.S. PATENT DOCUMENTS 3,707,813 A * 1/1973 Cymbrowitz ..... E04B 1/34807 D25/4
3,712,007 A * 1/1973 Kump ..... E04B 1/34807 52/79.8
3,722,153 A * 3/1973 Baer ..... E04B 1/32 D25/13
3,791,080 A * 2/1974 Sjoberg ..... B63B 3/08 D25/4
3,838,545 A * 10/1974 Kump ..... E04B 1/34815 52/79.8
3,854,255 A * 12/1974 Baker ..... E04B 1/3211 D25/13
3,905,167 A * 9/1975 Watkins ..... B32B 27/12 D25/4
3,945,156 A * 3/1976 Hamm ..... E04H 15/22 52/63
3,945,160 A * 3/1976 Grosser ..... E04B 7/105 D25/13
3,955,328 A * 5/1976 Lindsay ..... E04B 1/34846 52/79.8
4,059,932 A * 11/1977 Resch ..... E04B 1/32 52/81.1
4,258,823 A * 3/1981 Ganz ..... F02C 7/045 181/220
4,306,392 A * 12/1981 SoRelle ..... E04B 1/3211 52/81.1
4,343,117 A * 8/1982 Shemitz ..... E04B 2/7405 52/DIG. 10
4,509,500 A * 4/1985 Mori ..... F24S 50/20 136/246
4,546,583 A * 10/1985 Hussar ..... E04B 1/04 52/236.1
4,583,330 A * 4/1986 Huang ..... E04H 3/14 52/81.3
4,621,467 A * 11/1986 Golden ..... E04B 1/3211 D25/13
4,750,304 A * 6/1988 Bischoff ..... B65D 90/08 52/277
4,798,032 A * 1/1989 Rose, Jr. ..... E04B 1/3211 D25/13
4,942,700 A * 7/1990 Hoberman ..... E04B 1/3211 52/109
5,100,359 A * 3/1992 Gorio ..... A63F 9/12 446/124
5,145,130 A * 9/1992 Purves ..... B64G 1/646 901/1
5,181,355 A * 1/1993 Skolnick ..... E04B 1/3211 52/81.3
5,394,897 A * 3/1995 Ritchey ..... E04H 15/18 52/79.8
5,406,757 A * 4/1995 Fleishman ..... E04B 1/3211 135/15.1
5,524,396 A * 6/1996 Lalvani ..... E04B 1/19 52/311.2
5,623,790 A * 4/1997 Lalvani ..... A63H 33/04 52/81.2
5,706,624 A * 1/1998 Lipson ..... E04B 1/3211 403/403
6,173,538 B1 * 1/2001 Fleishman ..... E04B 1/34815 52/81.3
6,202,365 B1 * 3/2001 Provitola ..... E04B 1/32 52/80.1
6,701,691 B1 * 3/2004 Niiduma ..... E04B 1/3211 52/81.3
6,708,455 B1 * 3/2004 Niiduma ..... E04B 1/3211 52/81.3
6,988,969 B2 * 1/2006 Avis ..... A63B 41/08 473/604
7,192,329 B2 * 3/2007 Lee ..... A63H 33/22 446/116
7,434,359 B2 * 10/2008 Geiger ..... E04B 1/3211 446/116
7,662,014 B2 * 2/2010 Fleishman ..... A63H 33/084 52/645
7,765,746 B2 * 8/2010 Reed ..... E04B 1/3211 52/80.1
8,042,562 B1 * 10/2011 McDaniel, Jr. ..... E04H 15/008 52/36.2
8,100,814 B2 * 1/2012 Van Raalte ..... A63B 69/0048 403/172
8,480,449 B2 * 7/2013 Cheng ..... A63H 33/06 446/124
8,539,735 B2 * 9/2013 Belicofski ..... E04B 1/3211 52/745.07
8,763,326 B2 * 7/2014 Takeshima ..... E04H 9/028 52/236.1
8,863,447 B2 * 10/2014 Bischoff ..... E04B 1/3211 52/81.3
9,013,102 B1 * 4/2015 Wedding ..... H01J 11/18 250/374
9,103,110 B1 * 8/2015 Gerber ..... E04C 2/38
D787,519 S * 5/2017 Nolan ..... D14/440
9,720,881 B2 * 8/2017 Schein ..... G09B 23/04
9,903,107 B1 * 2/2018 Albright ..... E04C 3/00
9,949,562 B2 * 4/2018 Carson ..... A47B 21/06
10,415,231 B1 * 9/2019 Pramov ..... E04B 1/3211
10,443,237 B2 * 10/2019 Lanahan ..... F16S 3/00
10,487,494 B1 * 11/2019 Roberts ..... E04B 2/16
10,694,688 B2 * 6/2020 Kitagawa ..... A01G 9/1438
D914,303 S * 3/2021 Tuthill ..... D30/160
11,058,961 B2 * 7/2021 Matson ..... E04B 1/12
2007/0039254 A1 * 2/2007 Onda ..... B63C 11/49 52/81.1
2010/0095605 A1 * 4/2010 Belicofski ..... E04B 1/3211 52/81.1
2015/0225976 A1 * 8/2015 Carlson ..... E04H 9/14 52/79.5
2018/0112385 A1 * 4/2018 VanHoose ..... E03F 5/10
2020/0011054 A1 * 1/2020 Stafford ..... E04B 1/343
2020/0087943 A1 * 3/2020 Mather ..... E04B 1/948
2023/0141407 A1 * 5/2023 Van Egmond ..... B64B 1/08 244/119

FOREIGN PATENT DOCUMENTS

DE 3306051 A1 * 8/1984 ..... A63H 33/04
FR 2185080 A5 * 12/1973 ..... E04H 7/14
GB 1328631 A * 8/1973 ..... E04B 1/3211
GB 2111096 A * 6/1983 ..... E04B 1/19
GB 2148971 A * 6/1985 ..... E04B 1/3211
GB 2208081 A * 2/1989 ..... E04B 1/3211
KR 20-0120216 Y1 7/1998
KR 10-2001-0096002 A 11/2001
KR 20020056632 A * 7/2002 ..... E04B 1/3211
KR 10-0761522 B1 10/2007
KR 20020074693 A * 10/2010
KR 20110006170 A * 1/2011 ..... E04H 15/18
KR 20190087918 A * 7/2019 ..... E04D 13/035
KR 20210031871 A * 3/2021 ..... E04B 1/32
NL 9002258 A * 5/1992 ..... E04B 1/3211
WO WO-9426991 A1 * 11/1994 ..... E04B 1/3211
WO WO-9633320 A1 * 10/1996 ..... E04B 1/3211
WO WO-9831883 A1 * 7/1998 ..... E04B 1/3211
WO WO-2008020843 A1 * 2/2008 ..... E02B 3/04
WO WO-2018009936 A2 * 1/2018 ..... E06B 3/6722
WO WO-2019038569 A1 * 2/2019 ..... E04B 1/3211

* cited by examiner

GEODESIC DOME STRUCTURE INCLUDING VERTICAL DOORWAY

CROSS REFERENCE TO RELATED APPLICATION

This application claims priority from Korean Patent Application No. 10-2022-0163606, filed on Nov. 30, 2022, which is hereby incorporated by reference for all purposes as if fully set forth herein.

BACKGROUND

Field

The present disclosure relates to a geodesic dome structure having a doorway in a vertical plane and, more particularly, to a geodesic dome structure configured such that a doorway of the geodesic dome structure is formed to be perpendicular to the floor plane to prevent snow and rainwater from accumulating and to allow a plurality of dome structures to be connected by attaching the doorways of the adjacent dome structures to each other.

Description

With the advancement of construction technology and construction materials and as construction structures, construction methods, designs, and the like have become highly advanced, various construction methods, structures, systems, and the like for constructing buildings have been developed, one of which is the geodesic dome.

After a spherical dome was designed by German engineer Walther Bauersfeld, American designer Buckminster Fuller coined the term "geodesic dome" while elaborating on the construction methods and theories of the uses of domes.

A geodesic dome is a dome-shaped structure formed by connecting lightweight polygonal structures in tension along geodesic lines. A geodesic line is the shortest path from one point to another on a curve (or a circle).

In describing the characteristics of the geodesic dome, a dome formed by dividing an icosahedron, the shape of which is closest to the shape of a sphere, is specifically referred to as a geodesic dome. The geodesic dome is the strongest structure among domes because it is built by connecting hexagonal and pentagonal frames that have little deformation even under large forces.

To construct a large geodesic dome having sufficient strength as described above, a dome having a very light and strong structure may be constructed with a less material by converting the hexagonal and pentagonal frames of steel frames into a triangular skeleton.

Dome-shaped structures are resistant to natural disasters such as earthquakes and typhoons, and thus major facilities such as nuclear power plants are built with a dome structure. Dome-shaped structures have the smallest external surface area among three-dimensional shapes with the same volume, so a larger space may be achieved with less material, and heating and cooling may be advantageous due to the smaller surface area exposed externally.

A structure using such a geodesic dome as the roof or the exterior wall is referred to as a geodesic dome house. It may be easy to design buildings with a larger or smaller size without separate columns (or supports) by connecting frames of pentagons and hexagons in the manner of a soccer ball. Depending on the material of the exterior walls of the geodesic dome house, the entire interior space may be flooded with natural light. Accordingly, the use of geodesic domes is gradually expanding from large buildings, such as soccer stadiums, concert halls, event centers, exhibition halls, and warehouses, to smaller buildings, such as small houses for domestic use and replacement structures for greenhouses for growing crops.

To construct a geodesic dome, a plurality of skeletal frames, hub connectors connecting the frames, and panels covering the space defined by the connected frames may be necessary. Among such components, the connectors are disposed at respective vertex areas of the geodesic dome and are used to connect the adjacent frames to form the skeleton of the geodesic dome. By connecting the frames to the connectors and fitting the panels to the respective planes defined between the frames, the geodesic dome may be completed.

However, in a geodesic dome-shaped building of the related art, due to the structural shape closest to a spherical shape, the panels forming the doorway of the icosahedron are fitted together in an upwardly or downwardly inclined form, and automatically rotate in the direction of opening or closing under the weight of the doorway door, thereby causing inconvenience when using the door.

Therefore, a separate cover plate has been added to the panels forming the doorway such that the cover plate protrudes, the door has been disposed to be perpendicular to the floor surface, or the shape of one or more frames forming the doorway has been modified so that the panels are perpendicular to the floor surface. However, a problem in which the robustness of the geodesic dome was reduced due to the deformation of the hub connector(s) and frame(s) may be encountered.

The information disclosed in the Background section is only provided for a better understanding of the background and should not be taken as an acknowledgment or any form of suggestion that this information forms prior art that would already be known to a person having ordinary skill in the art.

RELATED ART DOCUMENT

Patent Document 1: Korean Patent No. 10-0761522 (published on Sep. 18, 2007; entitled "BIO GEODESIC DOME HAVING A GEODESIC DOME AND A WATER TUBE ON THE GEODESIC DOME TO MAINTAIN OPTIMAL CONDITION FOR PLANT CULTIVATION")

BRIEF SUMMARY

Various aspects of the present disclosure provide a geodesic dome structure configured such that the central vertical axis of the geodesic dome is inclined and the structural shape of the geodesic dome is maintained, thereby allowing a doorway to be disposed to be perpendicular to the floor plane.

Also provided is a geodesic dome structure configured such that the vertical axis is inclined such that hexagonal vertical planes are only disposed on the front and rear sides of the geodesic dome and an uppermost pentagonal planar member is inclined toward the doorway, thereby allowing rainwater or the like to easily drain along the inclined surface.

Also provided is a geodesic dome structure configured such that the doorway of the geodesic dome is disposed vertically to be easily docked with or connected to the doorway of another geodesic dome in a simple manner, thereby facilitating the expansion of the geodesic dome structure and improving the ease of use of the geodesic dome structure.

In order to achieve at least one of the above objectives, the present disclosure provides a geodesic dome structure having a doorway in a vertical plane, the geodesic dome structure including: a single upper pentagonal planar member provided at a topmost position; five upper hexagonal planar members with vertices thereof meeting facing vertices of the upper pentagonal planar member; five middle pentagonal planar members disposed between the upper hexagonal planar members, with upper vertices thereof meeting corresponding vertices of the upper hexagonal planar member; five middle hexagonal planar members disposed between the upper hexagonal planar members and the middle pentagonal planar members, with upper vertices thereof meeting corresponding vertices of the upper hexagonal planar members and the middle pentagonal planar members; a single lower doorway hexagonal planar member disposed between the middle hexagonal planar members, with upper vertices thereof meeting corresponding vertices of a corresponding middle pentagonal planar member of the middle pentagonal planar members and corresponding middle hexagonal planar members of the middle hexagonal planar members, wherein the single lower doorway hexagonal planar member and a facing single middle doorway hexagonal planar member are disposed to be perpendicular to a floor surface; and lower base planar members provided between and connecting the middle doorway hexagonal planar member and the lower doorway hexagonal planar member, vertex-connected to the middle pentagonal planar members and the middle hexagonal planar members, and supported on the floor surface.

In addition, the lower base planar members may include: a first base planar member disposed between and vertex-connected to the middle doorway hexagonal planar member and a corresponding middle hexagonal planar member of the middle hexagonal planar members; a second base planar member disposed between and vertex-connected to the first base planar member and the middle hexagonal planar member; a third base planar member disposed between the middle hexagonal planar member and another middle hexagonal planar member of the middle hexagonal planar members and vertex-connected to the middle pentagonal planar members and the second base planar member; and a fourth base planar member disposed between and vertex-connected to the third base planar member, the other middle hexagonal planar member, and the lower doorway hexagonal planar member.

In addition, the upper pentagonal planar member may be disposed on a central line connecting the middle doorway hexagonal planar member and the lower doorway hexagonal planar member and inclined upward 9° to 13° in a direction from the middle doorway hexagonal planar member to the lower doorway hexagonal planar member.

In addition, the lower base planar members may be inclined upward 9° to 13° in a direction from the middle doorway hexagonal planar member to the lower doorway hexagonal planar member with respect to the floor surface.

In addition, each of the middle doorway hexagonal planar member and the lower doorway hexagonal planar member may include a doorway including a door rotatable to open or close.

In addition, each of the middle doorway hexagonal planar member and the lower doorway hexagonal planar member may further include a docking means disposed around the doorway.

In addition, each of the pentagonal planar members and the hexagonal planar members may include: frames each having a predetermined length and including a fastener at a leading end thereof; a hub connector configured to be fastened with the fasteners of the frames to form a vertex; and a panel configured to be fitted into a pentagonal or hexagonal space defined by fitting the frames and the hub connected together.

According to the present disclosure as set forth above, the geodesic dome structure may be configured such that the central vertical axis thereof is inclined while maintaining the structural shape thereof, such that a doorway may be disposed to be perpendicular to the floor plane, thereby increasing the ease of entry and exit and improving the ease of use.

In addition, the pentagonal planar member disposed at the uppermost position of the geodesic dome may be inclined together with the vertical axis, such that dust, falling leaves, rainwater, or the like may easily drain along the inclined surface, thereby improving the ease of maintenance.

In addition, the doorway of the geodesic dome may be disposed vertically to be easily docked with or connected to the doorway of another geodesic dome in a simple manner, thereby facilitating the expansion of the geodesic dome structure and improving the ease of use of the geodesic dome structure.

In addition, the present disclosure has a variety of effects with excellent versatility depending on the embodiment, and such effects may be clearly understood from the following description of embodiments.

DESCRIPTION OF DRAWINGS

The above and other objectives, features, and advantages of the present disclosure will be more clearly understood from the following detailed description, taken in conjunction with the accompanying drawings, in which.

DETAILED DESCRIPTION

Figure 1:
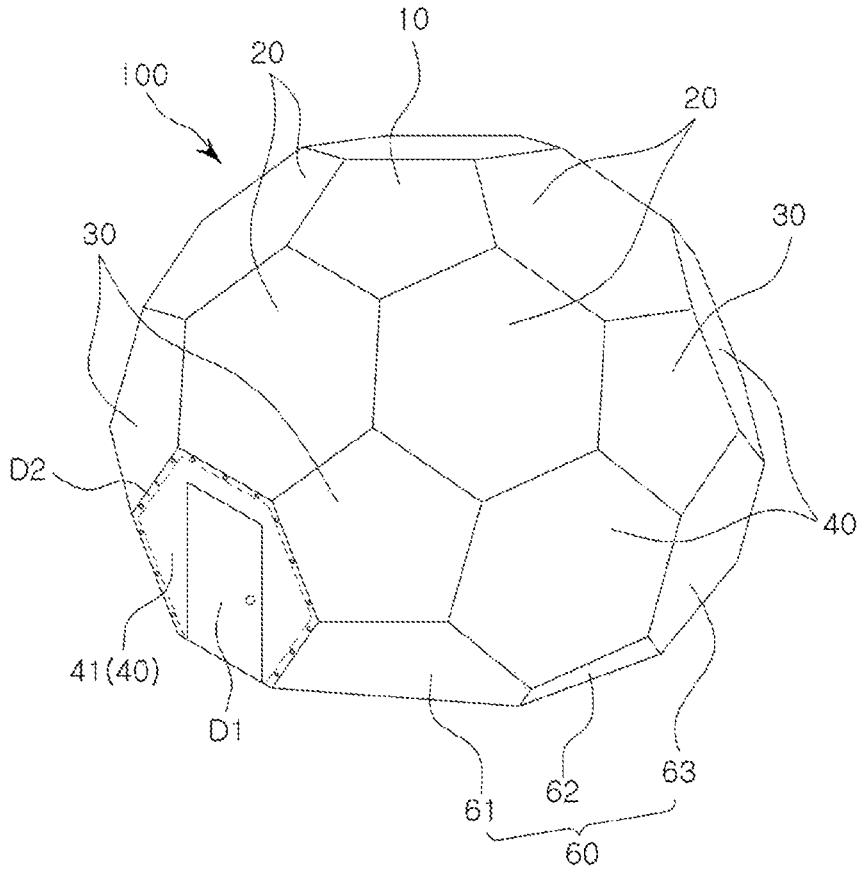
FIG. 1 is a perspective view illustrating a geodesic dome structure including a doorway in a vertical plane according to embodiments of the present disclosure.

Hereinafter, embodiments of the present disclosure will be described in detail with reference to the illustrative drawings.

In designating elements of the drawings by reference numerals, the same elements will be designated by the same reference numerals although they are shown in different drawings. Further, in the following description of the present disclosure, a detailed description of known functions and configurations incorporated herein will be omitted in the situation in which the subject matter of the present disclosure may be rendered unclear thereby.

In addition, the sizes or shapes of components illustrated in the drawings may be exaggerated for the sake of clarity or convenience. Further, terms specially defined by taking the configurations and functions of the present disclosure into consideration are provided only for illustrate embodiments of the present disclosure while not being limitative.

Hereinafter, a configuration according to embodiments of the present disclosure will be described with reference to the accompanying drawings.

Figure 2:
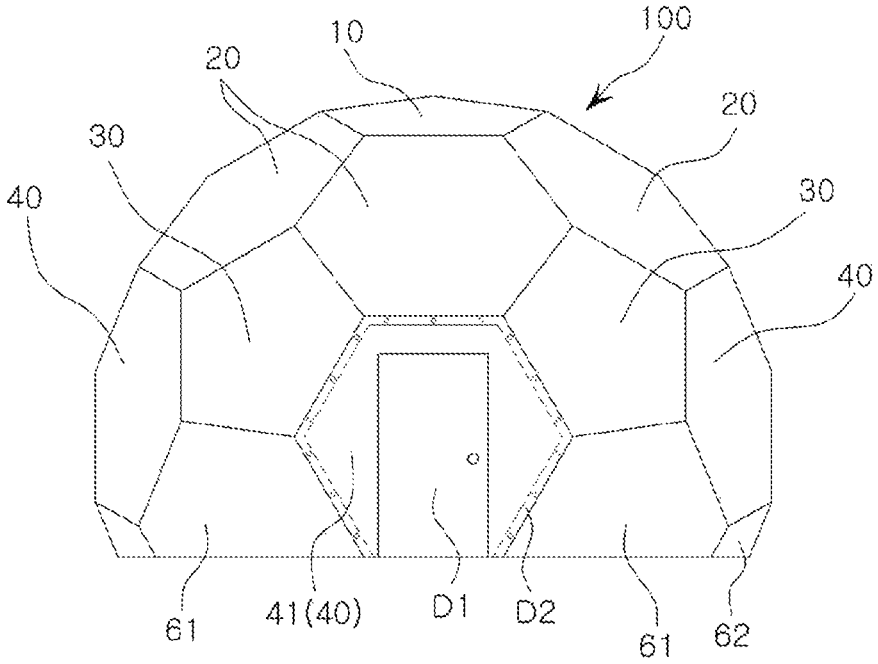
FIG. 2 is a front view illustrating the geodesic dome structure according to embodiments of the present disclosure.
Figure 3:
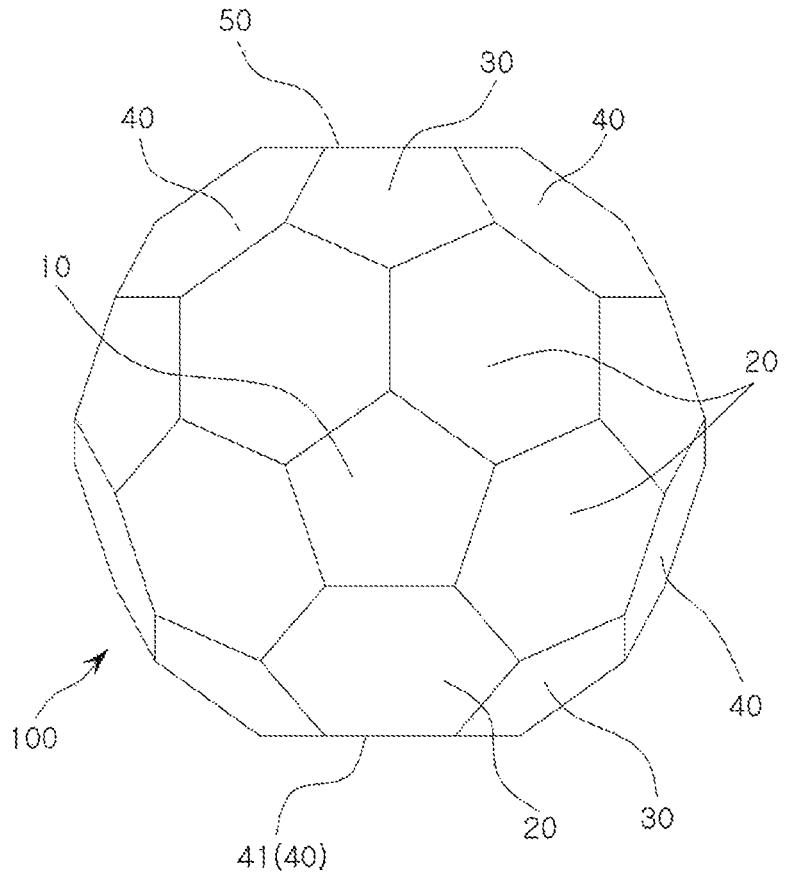
FIG. 3 is a plan view illustrating the geodesic dome structure according to embodiments of the present disclosure.
Figure 4:
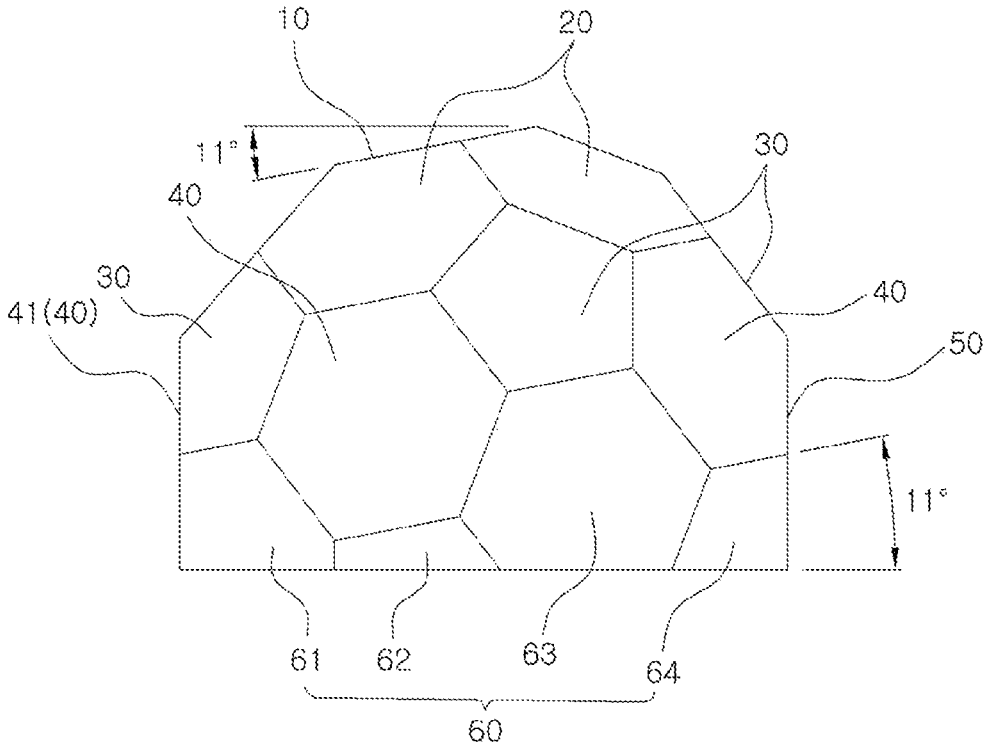
FIG. 4 is a side view illustrating the geodesic dome structure according to embodiments of the present disclosure.

FIG. 1 is a perspective view illustrating a geodesic dome structure including a doorway in a vertical plane according to embodiments of the present disclosure, FIG. 2 is a front view illustrating the geodesic dome structure according to embodiments of the present disclosure, FIG. 3 is a plan view illustrating the geodesic dome structure according to embodiments of the present disclosure, and FIG. 4 is a side view illustrating the geodesic dome structure according to embodiments of the present disclosure.

Figure 5:
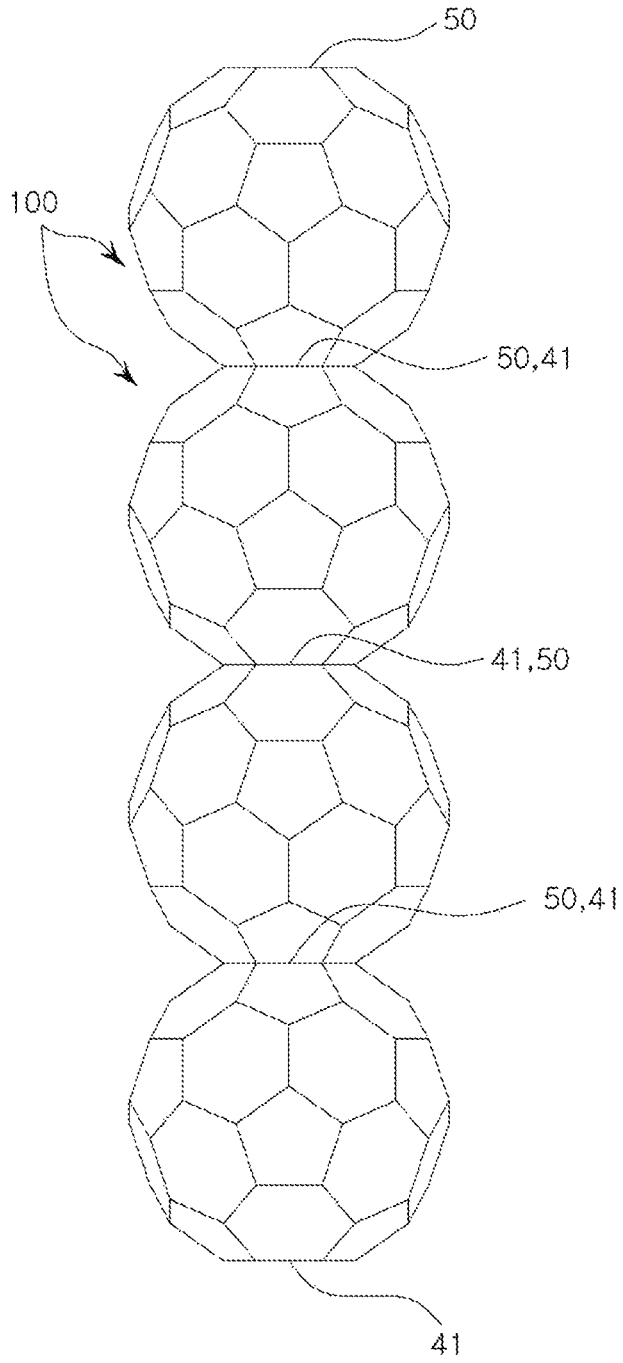
FIG. 5 is a plan view illustrating an example in which the geodesic dome structures according to embodiments of the present disclosure are used.

In addition, FIG. 5 is a plan view illustrating an example in which the geodesic dome structures according to embodiments of the present disclosure are used.

As illustrated in FIGS. 1 to 5, a geodesic dome structure 100 according to embodiments of the present disclosure is a dome-shaped structure constructed by fitting two types of polygonal planar members of regular pentagons and regular hexagons together so as to be vertex-connected. A doorway of the dome structure is formed to be perpendicular to the floor plane to increase the ease of entry and exit. A plurality of dome structures may be connected by docking the doorways of one dome structure with the doorways of the adjacent dome structures, thereby improving the use of space.

First, the two types of polygonal planar members of regular pentagons and regular hexagons according to the present disclosure are connected by connecting frames (not shown) each having a certain length and provided with a fastener at a leading end and hub connectors (not shown) each configured to be fastened with the fasteners of corresponding frames to form a vertex of a pentagon or a hexagon. Panels (not shown) are fitted into the pentagonal or hexagonal spaces, thereby constructing respective polygonal planar members. The configuration for assembling the polygonal planar members is not limited to a specific configuration, as various configurations may be used as needed by a person having ordinary knowledge in the art.

In addition, according to present disclosure, each of the pentagonal or hexagonal planar members may further include a central connector (not shown) at the center thereof at which vertices and frames are connected to form the same triangular spaces into which triangular panels are fitted, respectively. Note that, in the connection of the vertices described below, the front ends of frames are fitted to a hub connector, with each side relating to the length of each frame.

Generally, in the geodesic dome structure 100 according to the present disclosure, an upper pentagonal planar member 10, upper hexagonal planar members 20, middle pentagonal planar members 30, and middle hexagonal planar members 40 are vertex-connected so as to create a dome shape. The single upper pentagonal planar member 10 is placed at the topmost position, and the five upper hexagonal planar members 20 are fitted to the sides of the upper pentagonal planar member 10, respectively, so that the corresponding vertices meet.

In addition, the five middle pentagonal planar members are disposed in "^" shaped areas defined between the upper hexagonal planar members 20, respectively, and the upper three vertices of each of the middle pentagonal planar members 30 meet the corresponding vertices of the upper hexagonal planar members 20.

In addition, the five middle hexagonal planar members 40 are located between the middle pentagonal planar members 30 such that the upper sides thereof contact the lower sides of the upper hexagonal planar members 20, respectively, with vertices thereof meeting the corresponding vertices of the upper hexagonal planar members 20 and the middle pentagonal planar members 30.

Here, one of the middle hexagonal planar members 40 of the dome shape is separately referred to as a middle doorway hexagonal planar member 41. The middle doorway hexagonal planar member 41 is disposed in a direction perpendicular to the floor surface.

In addition, on the other side of the dome structure 100 #opposite the middle doorway hexagonal planar member 41, a single lower doorway hexagonal planar member 50 is disposed between the middle hexagonal planar members 40. The upper side of the lower doorway hexagonal planar member 50 contacts the lower side of the corresponding middle pentagonal planar member 30, and the upper vertices of the lower doorway hexagonal planar member 50 meet corresponding vertices of the middle pentagonal planar member 30 and the middle hexagonal planar members 40.

Accordingly, when the middle doorway hexagonal planar member 41 is disposed to be perpendicular to the floor surface on the left side of the figure as illustrated in FIG. 2, the dome structure including the middle hexagonal planar member 40 located on the right side of the view may be inclined 9° to 13° counterclockwise, and the lower doorway hexagonal planar member 50 may also be disposed to be perpendicular to the floor surface.

The lower doorway hexagonal planar member 50 is disposed to be perpendicular to the floor surface in one direction opposite the middle doorway hexagonal planar member 41 so as to be located between and vertex-connected to the middle pentagonal planar member 30 and the middle hexagonal planar members 40.

In addition, when the lower doorway hexagonal planar member 50 opposite the middle doorway hexagonal planar member 41 is supported on the floor surface, lower base planar members 60 are provided between the middle doorway hexagonal planar member 41 and the lower doorway hexagonal planar member 50 and below the middle hexagonal planar members 40 so as to be vertex-connected. This configuration may provide the ease of construction of the dome structure and improve the strength of the dome structure.

Accordingly, in the dome structure 100 according to the present disclosure, because the middle doorway hexagonal planar member 41 and the lower doorway hexagonal planar member 50 opposite each other are disposed in a direction perpendicular to the floor surface, the central vertical axis of the dome structure 100 is inclined in the direction of the middle doorway hexagonal planar member 41, and the upper pentagonal planar member 10 fitted to the topmost plane has a slope of 9° to 13°. With this configuration, leaves or rainwater falling on the dome structure 100 may naturally flow down along the slope on the outside of the dome structure 100.

In addition, each of the middle doorway hexagonal planar member 41 and the lower doorway hexagonal planar member 50 may be provided with a doorway D1 having a door rotatable to open and close. A docking means D2 allowing a connection to the doorway of another dome structure 100 is further provided around the doorway D1. The docking means D2 includes a female member and a male member provided on the middle doorway hexagonal planar member 41 and the lower doorway hexagonal planar member 50, respectively. With this configuration, the docking means D2 may be connected to docking means D2 of middle and lower doorway hexagonal planar members 41 and 50 of other dome structures 100 by a male-female connection. The docking means D2 is not limited to a specific configuration, as various configurations may be used as needed by a person having ordinary knowledge in the art.

Here, the doorway D1 and the door provided on each of the middle doorway hexagonal planar member 41 and the lower doorway hexagonal planar member 50 of the dome structure 100 are not limited to specific configurations, as various configurations may be used as needed by a person having ordinary knowledge in the art. The doorway D1 and the door are configured such that the door disposed in a direction perpendicular to the floor surface may be easily opened or closed.

In addition, the middle doorway hexagonal planar members 41 and the lower doorway hexagonal planar members 50 of a plurality of dome structures 100 may be connected using the docking means D2, thereby expanding the dome structure and improving the use of space of the dome structure.

In addition, the lower base planar members 60 are disposed on both sides connecting the middle doorway hexagonal planar member 41 and the lower doorway hexagonal planar member 50 and supported on the floor surface, with the vertices thereof meeting the lower vertices of the middle pentagonal planar members 30 and the middle hexagonal planar members 40. The lower base planar members 60 may be configured to be inclined upward 9° to 13° in the direction from the middle doorway hexagonal planar member 41 to the lower doorway hexagonal planar member 50 with respect to the floor surface, corresponding to the angle at which the central vertical axis of the dome structure 100 is inclined, thereby stably supporting the lower portions of the middle pentagonal planar members 30 and the middle hexagonal planar members 40.

The lower base planar members 60 generally include first base planar members 61, second base planar members 62, third base planar members 63, and fourth base planar members 64 sequentially arranged in the direction from the middle doorway hexagonal planar member 41 to the lower doorway hexagonal planar member 50. To this end, the lower base planar members 60 (61, 62, 63, and 64) may be formed by cutting the pentagonal planar members and the hexagonal planar members described above according to sizes or manufactured as separate planar members to be vertex-connected to the middle pentagonal planar members and the middle hexagonal planar members 40.

Describing in more detail, each of the first base planar members 61 is formed by reshaping a hexagonal planar member according to the floor surface so that the lower portion thereof is supported on the floor surface and the upper vertices thereof meet the vertices of the middle doorway hexagonal planar member 41, the middle pentagonal planar member 30, and the middle hexagonal planar member 40.

The second base planar member 62 is formed by reshaping a pentagonal planar member according to the floor surface so that the lower portion thereof is supported on the floor surface and the upper vertices thereof meet the vertices of the first base planar member 61 and the middle hexagonal planar member 40.

The third base planar member 63 is formed by reshaping a hexagonal planar member according to the floor surface so that the lower portion thereof is supported on the floor surface, the upper portion thereof is disposed between the middle hexagonal planar members 40, the upper side thereof contacts the lower side of the middle pentagonal planar member 30, and the upper vertices thereof meet the vertices of the second base planar member 62, the middle pentagonal planar members 30, and the middle hexagonal planar members 40.

The fourth base planar member 64 is formed by reshaping a pentagonal planar member according to the floor surface so that the lower portion thereof is supported on the floor surface and the upper vertices thereof meet the vertices of the third base planar member 63, the middle hexagonal planar members 40, and the lower doorway hexagonal planar member 50.

Accordingly, in the geodesic dome structure 100 according to the present disclosure, with the middle doorway hexagonal planar member 41 and the lower doorway hexagonal planar member 50 being formed to be perpendicular to the floor surface, the upper pentagonal planar member 10 may have an angle of inclination, and a plurality of dome structures 100 may be connected in a simple manner, thereby improving the use of space.

The above description provides an example of the technical idea of the present disclosure for illustrative purposes only. Those having ordinary knowledge in the technical field, to which the present disclosure pertains, will appreciate that various modifications and changes are possible without departing from the essential features of the present disclosure.

The embodiments disclosed in the present disclosure are intended to illustrate rather than limit the scope of the technical idea of the present disclosure, and the scope of the present disclosure is not limited by the embodiments.

The scope of the present disclosure shall be construed on the basis of the accompanying claims in such a manner that all of the technical ideas included within the scope equivalent to the claims belong to the present disclosure.

What is claimed is:

1. A geodesic dome structure having a doorway in a vertical plane, the geodesic dome structure comprising:

a single upper pentagonal planar member provided at a topmost position;

five upper hexagonal planar members with vertices thereof meeting facing vertices of the upper pentagonal planar member;

five middle pentagonal planar members disposed between the upper hexagonal planar members, with upper vertices thereof meeting corresponding vertices of the upper hexagonal planar member;

four middle hexagonal planar members disposed between the upper hexagonal planar members and the middle pentagonal planar members, with upper vertices thereof meeting corresponding vertices of the upper hexagonal planar members and the middle pentagonal planar members;

a single lower doorway hexagonal planar member disposed between the middle hexagonal planar members, with upper vertices thereof meeting corresponding vertices of a corresponding middle pentagonal planar member of the middle pentagonal planar members and corresponding middle hexagonal planar members of the middle hexagonal planar members, wherein the single lower doorway hexagonal planar member is disposed to be perpendicular to a floor surface;

a single middle doorway hexagonal planar member disposed between the upper hexagonal planar members and the middle pentagonal planar members to face the lower doorway hexagonal planar member, with upper vertices thereof meeting corresponding vertices of the upper hexagonal planar members and the middle pentagonal planar members, wherein the single middle doorway hexagonal planar member is disposed to be perpendicular to the floor surface; and lower base planar members provided between and connecting the middle doorway hexagonal planar member and the lower doorway hexagonal planar member, vertex-connected to the middle pentagonal planar members and the middle hexagonal planar members, and supported on the floor surface, wherein the upper pentagonal planar member is disposed on a central line connecting the middle doorway hexagonal planar member and the lower doorway hexagonal planar member and inclined upward 9° to 13° in a direction from the middle doorway hexagonal planar member to the lower doorway hexagonal planar member, wherein each of the single middle doorway hexagonal planar member and the single lower doorway hexagonal planar member comprises a docking element including a female member and a male member provided on the single middle doorway hexagonal planar member and the single lower doorway hexagonal planar member, respectively.

2. The geodesic dome structure of claim 1, wherein the lower base planar members comprise:

a first base planar member disposed between and vertex-connected to the middle doorway hexagonal planar member and a corresponding middle hexagonal planar member of the middle hexagonal planar members;

a second base planar member disposed between and vertex-connected to the first base planar member and the middle hexagonal planar member;

a third base planar member disposed between the middle hexagonal planar member and another middle hexagonal planar member of the middle hexagonal planar members and vertex-connected to the middle pentagonal planar members and the second base planar member; and a fourth base planar member disposed between and vertex-connected to the third base planar member, the other middle hexagonal planar member, and the lower doorway hexagonal planar member.

3. The geodesic dome structure of claim 1, wherein each of the middle doorway hexagonal planar member and the lower doorway hexagonal planar member comprises a doorway comprising a door rotatable to open or close.

4. The geodesic dome structure of claim 1, wherein each of the pentagonal planar members and the hexagonal planar members comprises:

frames each having a predetermined length and comprising a fastener at a leading end thereof;

a hub connector configured to be fastened with the fasteners of the frames to form a vertex; and a panel configured to be fitted into a pentagonal or hexagonal space defined by fitting the frames and the hub connected together.

5. A geodesic dome structure having a doorway in a vertical plane, the geodesic dome structure comprising:

a single upper pentagonal planar member provided at a topmost position;

five upper hexagonal planar members with vertices thereof meeting facing vertices of the upper pentagonal planar member;

five middle pentagonal planar members disposed between the upper hexagonal planar members, with upper vertices thereof meeting corresponding vertices of the upper hexagonal planar member;

four middle hexagonal planar members disposed between the upper hexagonal planar members and the middle pentagonal planar members, with upper vertices thereof meeting corresponding vertices of the upper hexagonal planar members and the middle pentagonal planar members;

a single lower doorway hexagonal planar member disposed between the middle hexagonal planar members, with upper vertices thereof meeting corresponding vertices of a corresponding middle pentagonal planar member of the middle pentagonal planar members and corresponding middle hexagonal planar members of the middle hexagonal planar members, wherein the single lower doorway hexagonal planar member is disposed to be perpendicular to a floor surface;

a single middle doorway hexagonal planar member disposed between the upper hexagonal planar members and the middle pentagonal planar members to face the lower doorway hexagonal planar member, with upper vertices thereof meeting corresponding vertices of the upper hexagonal planar members and the middle pentagonal planar members, wherein the single middle doorway hexagonal planar member is disposed to be perpendicular to the floor surface; and lower base planar members provided between and connecting the middle doorway hexagonal planar member and the lower doorway hexagonal planar member, vertex-connected to the middle pentagonal planar members and the middle hexagonal planar members, and supported on the floor surface, wherein the lower base planar members are inclined upward 9° to 13° in a direction from the middle doorway hexagonal planar member to the lower doorway hexagonal planar member with respect to the floor surface, wherein each of the single middle doorway hexagonal planar member and the single lower doorway hexagonal planar member comprises a docking member including a female member and a male member provided on the single middle doorway hexagonal planar member and the single lower doorway hexagonal planar member, respectively.

6. The geodesic dome structure of claim 5, wherein each of the middle doorway hexagonal planar member and the lower doorway hexagonal planar member comprises a doorway comprising a door rotatable to open or close.

7. The geodesic dome structure of claim 5, wherein each of the pentagonal planar members and the hexagonal planar members comprises:

frames each having a predetermined length and comprising a fastener at a leading end thereof;

a hub connector configured to be fastened with the fasteners of the frames to form a vertex; and a panel configured to be fitted into a pentagonal or hexagonal space defined by fitting the frames and the hub connected together.

* * * * *